US010267132B2

(12) United States Patent
Hoeink

(10) Patent No.: US 10,267,132 B2
(45) Date of Patent: Apr. 23, 2019

(54) ELIMINATING DISCRETE FRACTURE NETWORK CALCULATIONS BY RIGOROUS MATHEMATICS

(71) Applicant: Tobias Hoeink, Houston, TX (US)

(72) Inventor: Tobias Hoeink, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 521 days.

(21) Appl. No.: 14/977,058

(22) Filed: Dec. 21, 2015

(65) Prior Publication Data

US 2017/0175507 A1 Jun. 22, 2017

(51) Int. Cl.
*E21B 43/26* (2006.01)

(52) U.S. Cl.
CPC ..... *E21B 43/26* (2013.01)

(58) Field of Classification Search
CPC ..... G06F 17/11; E21B 43/26
USPC ..... 703/2
See application file for complete search history.

(56) References Cited

U.S. PATENT DOCUMENTS 7,565,278 B2 * 7/2009 Li ..... G06F 17/5018 703/10
2002/0120429 A1 * 8/2002 Ortoleva ..... E21B 41/0064 703/2
2003/0168257 A1 * 9/2003 Aldred ..... E21B 44/00 175/24
2005/0267719 A1 * 12/2005 Foucault ..... E21B 44/00 703/10
2009/0152005 A1 * 6/2009 Chapman ..... E21B 7/00 175/24
2010/0312529 A1 * 12/2010 Souche ..... E21B 43/26 703/2
2012/0116740 A1 * 5/2012 Fourno ..... E21B 43/00 703/10
2012/0158380 A1 * 6/2012 Hajibeygi ..... E21B 43/26 703/2

(Continued)

OTHER PUBLICATIONS

McClure et al. ("Discrete Fracture Modeling of Hydraulic Stimulation in Enhanced Geothermal Systems", Stanford University, Stanford, California, Feb. 1-3, 2010, pp. 1-19).*

(Continued)

*Primary Examiner* — Kamini S Shah
*Assistant Examiner* — Iftekhar A Khan
(74) *Attorney, Agent, or Firm* — Cantor Colburn LLP

(57) ABSTRACT

A method for computing a production rate of hydrocarbons from an earth formation includes: obtaining information about a discrete fraction network relating to locations, orientations and apertures of fractures; computing an average distance of the fractures to a wellbore penetrating the formation and a standard deviation of the distances; computing an average velocity of fluid from each of the fractures to the wellbore and a standard deviation of the velocities; computing a characteristic time representing a time for fluid to flow from each fracture to the wellbore and a standard deviation of the characteristic times; computing a range of hydrocarbon production rates using the characteristic time and the standard deviation of the characteristic times to provide the range of hydrocarbon production rates as a function of standard deviation values; and providing a graph of the range of hydrocarbon production rates as a function of standard deviation values.

12 Claims, 6 Drawing Sheets

(56) References Cited

U.S. PATENT DOCUMENTS

2012/0318500 A1* 12/2012 Urbancic ..... E21B 43/26 166/250.1
2013/0096889 A1* 4/2013 Khvoenkova ..... G06F 17/10 703/2
2013/0304437 A1* 11/2013 Ma ..... G06F 17/5009 703/2
2014/0076543 A1* 3/2014 Ejofodomi ..... G01V 1/306 166/250.1
2014/0345945 A1* 11/2014 Hoeink ..... E21B 41/0092 175/50
2014/0358510 A1* 12/2014 Sarkar ..... G06F 17/5009 703/10
2014/0372089 A1* 12/2014 Weng ..... E21B 43/26 703/2
2014/0372094 A1* 12/2014 Holland ..... G01V 11/00 703/10
2015/0039234 A1* 2/2015 Abou-Sayed ..... G01V 99/00 702/11
2015/0345268 A1* 12/2015 Bryant ..... E21B 43/164 166/271
2015/0355374 A1* 12/2015 Morton ..... G01V 1/50 703/10
2016/0108705 A1* 4/2016 Maxwell ..... E21B 43/267 166/250.1
2016/0123119 A1* 5/2016 Tueckmantel ..... E21B 49/00 703/10
2016/0154129 A1* 6/2016 Sayers ..... E21B 43/26 702/13
2016/0177693 A1* 6/2016 Gomaa ..... E21B 43/267 166/250.07
2016/0215594 A1* 7/2016 Hoeink ..... E21B 41/0092
2017/0074770 A1* 3/2017 Fourno ..... G01N 15/082
2017/0096880 A1* 4/2017 Ben ..... E21B 7/00
2017/0298713 A1* 10/2017 Shetty ..... E21B 43/267
2017/0316130 A1* 11/2017 Shetty ..... E21B 43/267

OTHER PUBLICATIONS

Berrone et al. ("An optimization approach for large scale simulations of discrete fracture network flows", Journal of Computational Physics, vol. 256 (2014), pp. 838-853).*

Meyers et al. ("A Discrete Fracture Network Model for Hydraulically Induced Fractures: Theory, Parametric and Case Studies",Society of Petroleum Engineers, 2011, pp. 1-36).*

Khvoenkova, et al.; "An Optimal Method to Model Transient Flow in 3D Discrete Fracture Network"; 2011; IAMG Salzburg, Austria; 12 pages.

* cited by examiner

ELIMINATING DISCRETE FRACTURE NETWORK CALCULATIONS BY RIGOROUS MATHEMATICS

BACKGROUND

Production of hydrocarbons from earth formations can be very expensive especially when the formations require hydraulic fracturing. One way to limit costs is to improve efficiency such as in the use of production resources. Production resources in general can be more efficiently used by having accurate knowledge of properties of the formation related to the extraction of hydrocarbons. Hence, methods to quickly, accurately and efficiently determine the formation properties relating to the extraction of hydrocarbons would be well received by the hydrocarbon production industry.

BRIEF SUMMARY

Disclosed is a method for computing a production rate of hydrocarbons from an earth formation. The method includes: obtaining information about a discrete fraction network (DFN) using a processor, the information includes information relating to locations, orientations and apertures of fractures; computing, by the processor, an average distance of the fractures to a wellbore penetrating the formation and a standard deviation of the distances; computing, by the processor, an average velocity of fluid from each of the fractures represented in the DFN to the wellbore and a standard deviation of the velocities; computing, by the processor, a characteristic time representing a time for fluid to flow from each fracture represented in the DFN to the wellbore and a standard deviation of the characteristic times; computing, by the processor, a range of hydrocarbon production rates using the characteristic time and the standard deviation of the characteristic times to provide the range of hydrocarbon production rates as a function of standard deviation values; and providing, by the processor, a graph of the range of hydrocarbon production rates as a function of standard deviation values.

Also disclosed is an apparatus for computing a production rate of hydrocarbons from an earth formation. The apparatus includes a processor configured to: obtain information about a discrete fraction network (DFN), the information comprising information relating to locations, orientations and apertures of fractures; compute an average distance of the fractures to a wellbore penetrating the formation and a standard deviation of the distances; compute an average velocity of fluid from each of the fractures represented in the DFN to the wellbore and a standard deviation of the velocities; compute a characteristic time representing a time for fluid to flow from each fracture represented in the DFN to the wellbore and a standard deviation of the characteristic times; compute a range of hydrocarbon production rates using the characteristic time and the standard deviation of the characteristic times to provide the range of hydrocarbon production rates as a function of standard deviation values; and provide a graph of the range of hydrocarbon production rates as a function of standard deviation values.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
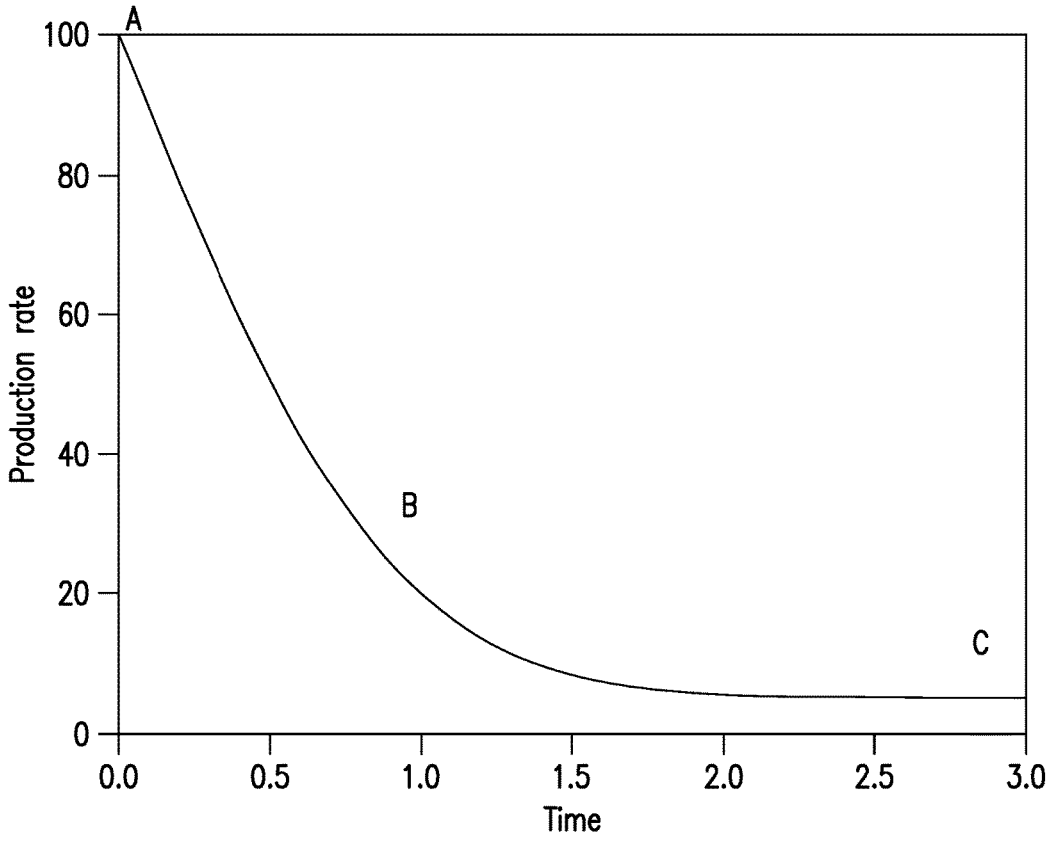
FIG. 1 depicts aspects of a hydrocarbon production curve.

A detailed description of one or more embodiments of the disclosed apparatus and method presented herein by way of exemplification and not limitation with reference to the figures.

Disclosed are methods and systems for quickly, accurately and efficiently estimating properties of an earth formation relating to the extraction of hydrocarbons. In lieu of calculating flow through each fracture of a discrete fracture network (DFN) representing rock fractures in the formation, which is typically computationally intensive, rigorous mathematics is applied to a stochastic description of the DFN to estimate the formation extraction properties. Once the formation fracture properties are estimated, they can be used as input for decisions regarding a hydrocarbon extraction process or even if hydrocarbon extraction should continue.

Networks of natural fractures are important contributors for fluid flow in the subsurface, and crucial in most remaining hydrocarbon reserves. However, in any realistic situation the actual physical attributes of each fracture are never known precisely. A typically used crutch employs the concept of a discrete natural fracture network (DFN), which is a discrete realization of a large number of possible realizations (ensemble) that all have the same stochastic description. Much work in the industry is focused on creating and analyzing a single (or a few at most) of those DFN's, disregarding the majority of possible realizations in the ensemble. Then, results from these singular efforts contribute to important and capital-expensive decisions. A DFN may be obtained from analysis of formation core samples and borehole logging images and sensed data such as resistivity images, nuclear magnetic resonance (NMR) images and gamma-ray data as non-limiting examples. Fracture densities, orientations and aperture distances may be extrapolated further into the formation from a borehole were the data was obtained. In that DFNs are known in the art, they are not discussed in further detail.

As disclosed herein, rather than using a single or a handful of DFN's, rigorous mathematics can be used to compute the relevant measures of the ensemble. Variables or parameters include fracture dimensions, network connectivity, material parameters, stress state, directional permeability, and characteristic length/time of gas path to fracture (which is the rate-limiting process after 6 months of productions). Following the central limit theorem, parameters can be described by (normal) distributions with defined mean and variances. Some might include long distribution tails, but the basic concept applies.

The method includes applying a set of mathematical operations that propagate means and variances from various input parameter distributions (e.g., fracture dimension, network connectivity, material parameters, . . . ) to the measure of interest. Mathematical operations include (1) rigorous computations on probability density functions, (2) applying perturbation theory using mean and variances for exact and perturbed solutions, and (3) estimating variance propagation by upper and lower bound methods.

An example of hydrocarbon production from a network of rock fractures in a formation is now discussed. In the oil and gas industry, the ultimate goal of invoking the concept of a discrete fracture network (DFN), and carrying the subsequent mathematical and computational burden of applying it, is to predict production curves for reservoirs in which DFNs contribute significantly, or exclusively as is the case in many low-permeability formations, to the overall production. Here, the example will demonstrate how the wealth of information regarding DFNs can be brought to bear on production curves without large-scale computational efforts.

A production curve as illustrated in FIG. 1 has three major characteristics, all of which can be related to characteristics of the fracture network that is responsible for transporting fluid. The production curve in FIG. 1 includes three major characteristics: initial rate of production (A), a decline in the production rate (B), and a limit rate of production (C).

The underlying assumption in a conceptual DFN model is that fractures have a much higher permeability than the formation in which they are embedded. The initial production from a set of natural fractures is therefore directly related to the total volume of connected fractures, as fluid inside the highly permeable fractures can readily flow to the well. Production readily declines, which will be discussed in more detail below, until a limit rate of production is reached. This limit is related to the ability of the formation to recharge the fractures with fluid, and can be described by a leak-in coefficient (a term used here in analogy to a more generally used term for hydraulic stimulation, leak-off). Because leak-in depends on the pressure difference between fracture interior pressure and formation pressure, the limit rate c is naturally a function of the pressure difference as well. In particular, as the formation is drained, the pressure difference will decrease and so will the leak-in rate c. As such, the leak-in rate c might not be considered a constant in all model scenarios. However, an extension from a constant leak-in rate c to a variable rate-in rate $c(p_{formation}, \ldots)$ is straightforward.

The decline of production stems from the decrease in formation pressure, which drives fluid towards the well, and is amplified by the discrepancy in permeability between fractures and formation. High-permeability fractures can be drained more quickly than the formation can supply new fluids. Clearly, many of the characteristics of a DFN influence the production decline, and there is no apparent limit to the complexity one can invoke to model this system.

Fundamentally, though, the flow of fluid through a fracture can be described by Darcy's law $$Q = \left(-\frac{kA}{v}\right)\nabla p, \tag{1}$$

which relates the flow rate Q (units of volume per time) to the pressure gradient ∇p along the fracture with cross-sectional area A and permeability k, for a fluid with viscosity v. The flow velocity u can be expressed as $$u = Q/A\phi, \tag{2}$$

where ϕ is the fracture porosity, i.e. the total available volume inside the fracture available for fluid flow. The variables in the above equations, in addition to fracture connectivity can theoretically be used to estimate production deterministically for a given DFN. However, given the large number of fractures typically involved, and the nature of statistically distributed properties, this is unfeasible die to the large amount of computational power required. Hence, instead of taking the deterministic route, the methods disclosed herein use a stochastic analysis.

The description of discrete fracture network properties can be captured by probability distributions. Whereas a number of different probability distributions may be used, without additional constraining knowledge the central limit theorem may be invoked and a normal distribution of properties assumed. The method disclosed herein does not rely on any specific distribution, and other distributions can be substituted without taking away the spirit of this invention.

If individual properties need to be considered collectively, a multivariate normal distribution can be used. In the present example we implicitly combine the probabilities of all individual properties and assume that the time it takes a fluid volume to flow from a fracture into the well is normally distributed, and denoted by t. Mean and standard deviation of this distribution are denoted with μ and σ, respectively. The probability that the time to well is larger than t is given by the tail probability of the standard normal distribution (which in the literature is referred to as the Q-function, but here is denoted with Ω to avoid confusion with the production rate Q):

$$\Omega(x) = \frac{1}{\sqrt{2\pi}}\int_x^\infty \exp\left(-\frac{s^2}{2}\right)ds, \tag{3}$$

where $x=(t-\mu)/\sigma$ and s is an integration variable. It is noted that Ω(x) can be expressed in terms of the complementary error function, erfc( ), as $\Omega(x)=\mathrm{erfc}(x/\sqrt{2})/2$.

The probability that the time to well exceeds t directly relates to the production rate at the well, which can be computed as $$Q(t)=(a-c)\,erfc(t/\tau)+c \tag{4}$$

where a is the initial rate of production, which is related to the total volume of fluid-filled fractures, c is the limit rate, which is related to the leak-in of formation fluid into the fracture network, and τ is the characteristic time of production decline. There are numerous ways to estimate the characteristic time of the system that someone skilled in the art will appreciate.

In one embodiment, the characteristic time is computed as the ratio of average fracture distance to the well over the average fluid velocity, $$\tau=\bar{d}/\bar{u} \tag{5a}$$

which in turn can be computed by an average flow rate following equations 1 and 2. The variations in initial property distributions can be propagated through these computations in a straightforward manner such that the final production reflects those variations.

For instance, consider that both fracture distance to the wellbore d and fluid velocity u have uncertainties that can be described by standard distributions $\sigma_d$ and $\sigma_u$, respectively, and that the covariance is denoted with $\sigma_{du}$. The variance of the characteristic time based on equation (5a) is then $$\sigma_\tau = \left|\frac{\bar{d}}{\bar{u}}\right| \sqrt{\left(\frac{\sigma_d}{\bar{d}}\right)^2 + \left(\frac{\sigma_u}{\bar{u}}\right)^2 - 2\left(\frac{\sigma_{du}}{\bar{d}\,\bar{u}}\right)^2} \tag{5b}$$

and can be used to derive confidence intervals for the characteristic time.

Figure 2:
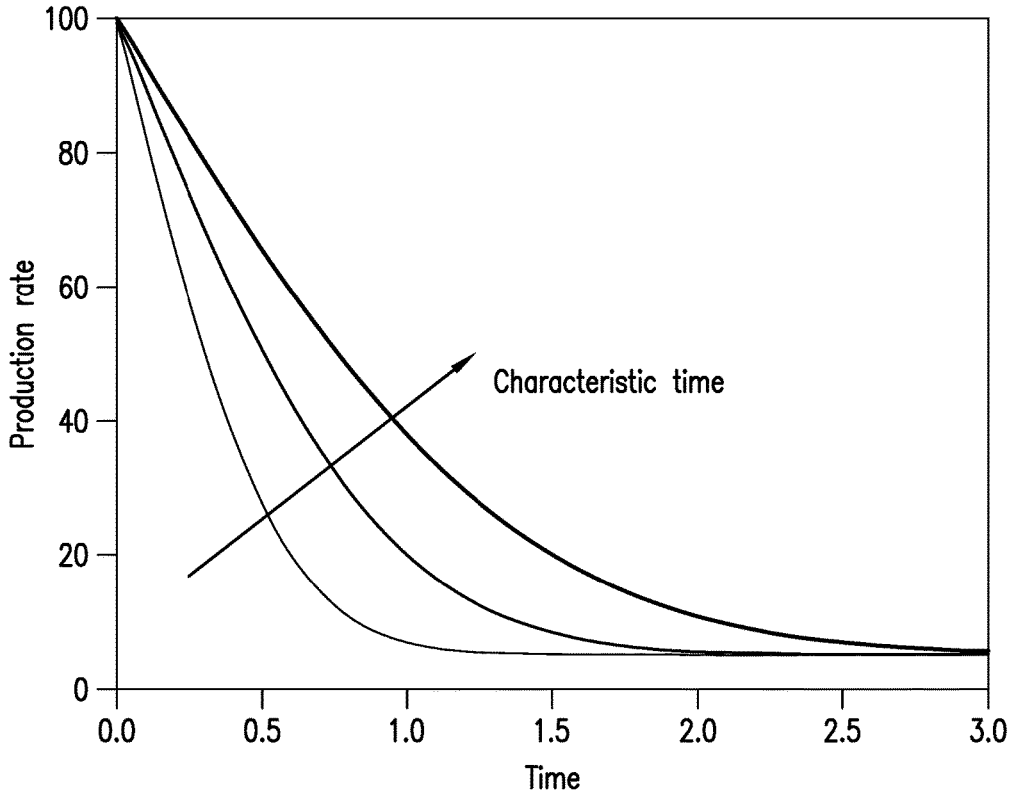
FIG. 2 depicts aspects of hydrocarbon production curves for three different characteristic times.
Figure 3:
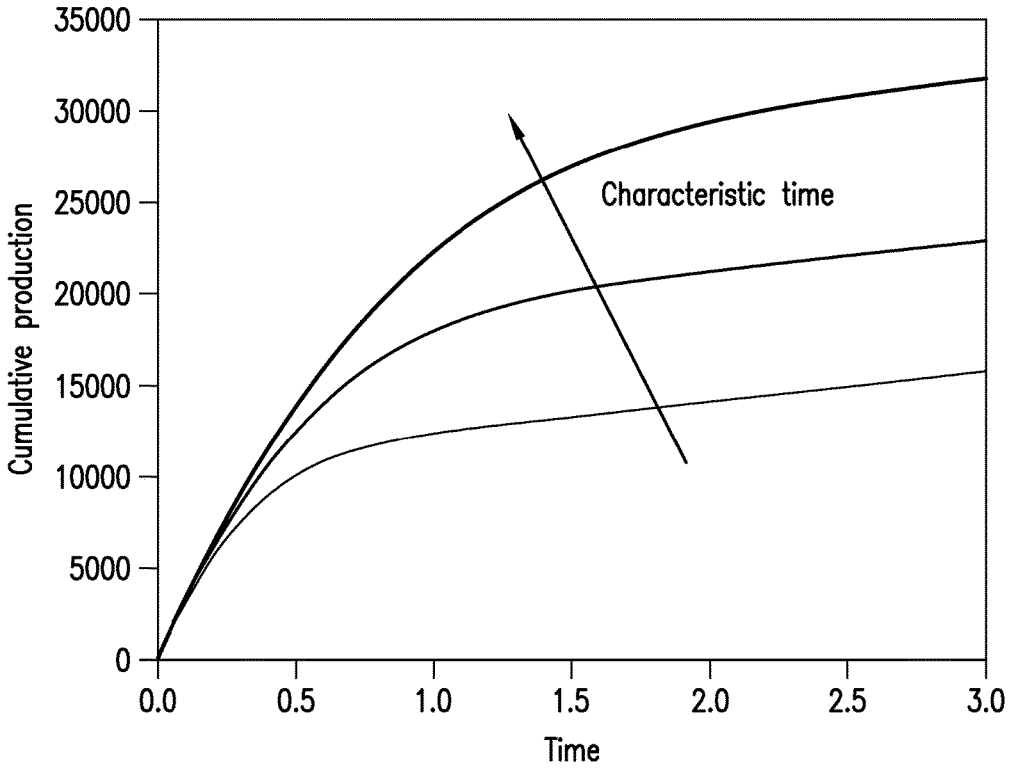
FIG. 3 depicts aspects of cumulative hydrocarbon production curves for the three different characteristic times.

FIG. 2 illustrates example production curves computed with equation (4) for three different characteristic times, $\tau-\sigma_\tau$, $\tau$ and $\tau+\sigma_\tau$. The decline in production rate is generally reduced for larger characteristic times. FIG. 3 illustrates the resulting corresponding cumulative production curves. In an actual application, tighter confidence intervals such as 3-sigma or 6-sigma may be plotted depending on the tolerance for risk of the hydrocarbon producer. Larger characteristic times result in increased cumulative production.

Alternatively, uncertainties can be rigorously propagated through equation (4) with every variable that is involved.

Although convenient and already very useful, there is no fundamental need for the characteristic time $\tau$ to be a constant. A functional dependence on porosity or permeability, or on the pore pressure in the formation may be employed in order to couple this model to another model. Thus, this model could drive or be driven from another model, in analogy to coupled geomechanical and reservoir simulation modeling techniques.

Further useful information may be derived from the methods disclosed above. Given a small sample of data points from an actual decline curve in the field, the simplicity of equation (4) allows for quickly calibrating parameters a, $\tau$, and c, which in turn allows a cumulative production forecast in very short time. This can be used to monitor an asset, and for planning additional stimulation, rejuvenation or abandonment activities.

Figure 4:
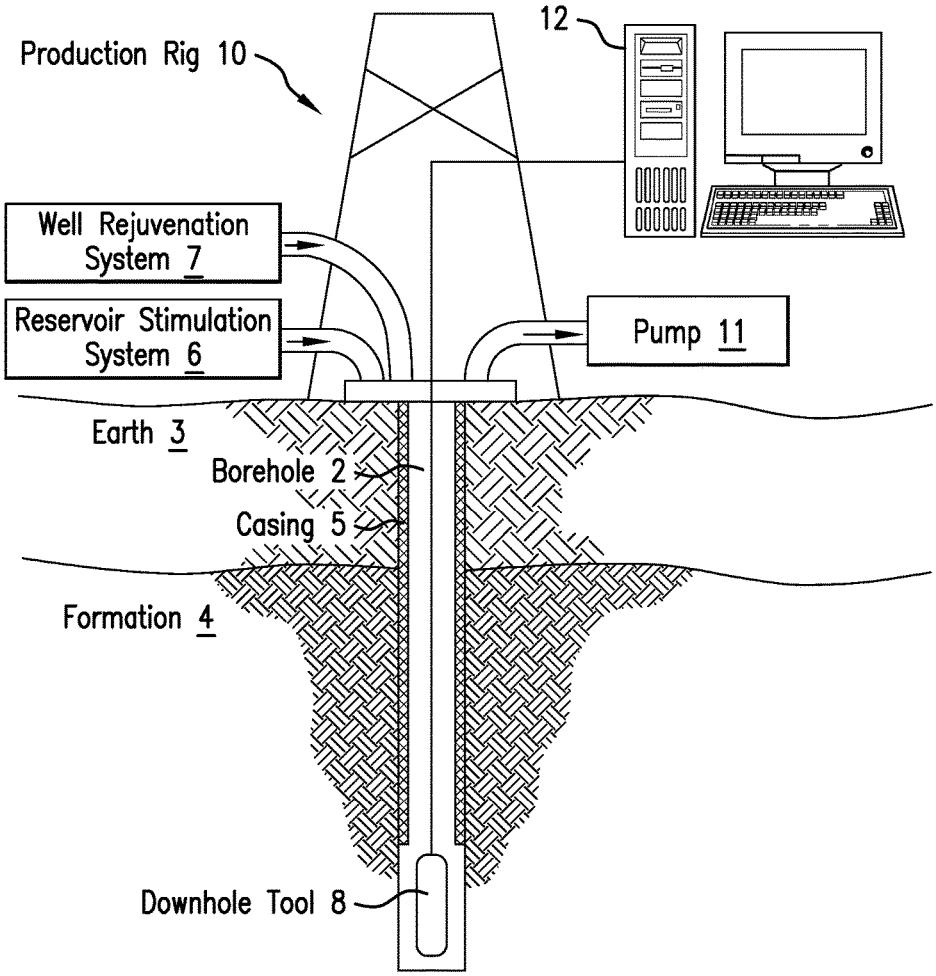
FIG. 4 illustrates a cross-sectional view of an embodiment of a hydrocarbon production rig for producing hydrocarbons from a borehole penetrating the earth formation.

FIG. 4 depicts aspects of production equipment for producing hydrocarbons from an earth formation. A production rig 10 is configured to perform actions related to the production of hydrocarbons from a borehole 2 (may also be referred to as a well or wellbore) penetrating the earth 3 having an earth formation 4. For example, the production rig 10 may include a pump 11 configured to pump hydrocarbons entering the borehole 2 to the surface. The formation 4 may contain a reservoir of hydrocarbons that are produced by the production rig 10. The borehole 2 may be lined by a casing 5 to prevent the borehole 2 from collapsing. The production rig 10 may include a reservoir stimulation system 6 configured to stimulate the earth formation 4 to increase the flow of hydrocarbons. In one or more embodiments, the reservoir stimulation system 6 is configured to hydraulically fracture rock in the formation 4. The production rig 10 may also include a well rejuvenation system 7 configured to rejuvenate the borehole 2 (e.g., increase hydrocarbon flow into the borehole 2). In one or more embodiments, the well rejuvenation system 7 includes an acid treatment system configured to inject acid into the borehole 2.

The production rig 10 may also be configured to log the formation 4 using a downhole tool 8. Non-limiting embodiments of the downhole tool 8 include a resistivity tool, a neutron tool, a gamma-ray tool, a nuclear magnetic resonance (NMR) tool, and an acoustic tool. The downhole tool 8 may be conveyed through the borehole 2 by an armored wireline that also provides communications to the surface. These tools may provide data for imaging a wall of the borehole 2 and thus image fractures in the formation 4 to determine lengths, orientation, and apertures of the fractures. The downhole tool 8 may also be configured to extract a core sample of the formation for analysis at the surface. The surface analysis may also determine lengths, orientation, and apertures of the fractures. The downhole logging and/or the surface analysis may be used to generate a DFN.

FIG. 4 also illustrates a computer processing system 12. The computer processing system 12 is configured to implement the methods disclosed herein. Further, the computer processing system 12 may be configured to act as a controller for controlling operations of the production rig 10 to include well logging and core sample extraction and analysis. Non-limiting examples of control actions include turning equipment on or off and executing processes for formation stimulation and well rejuvenation.

Figure 5:
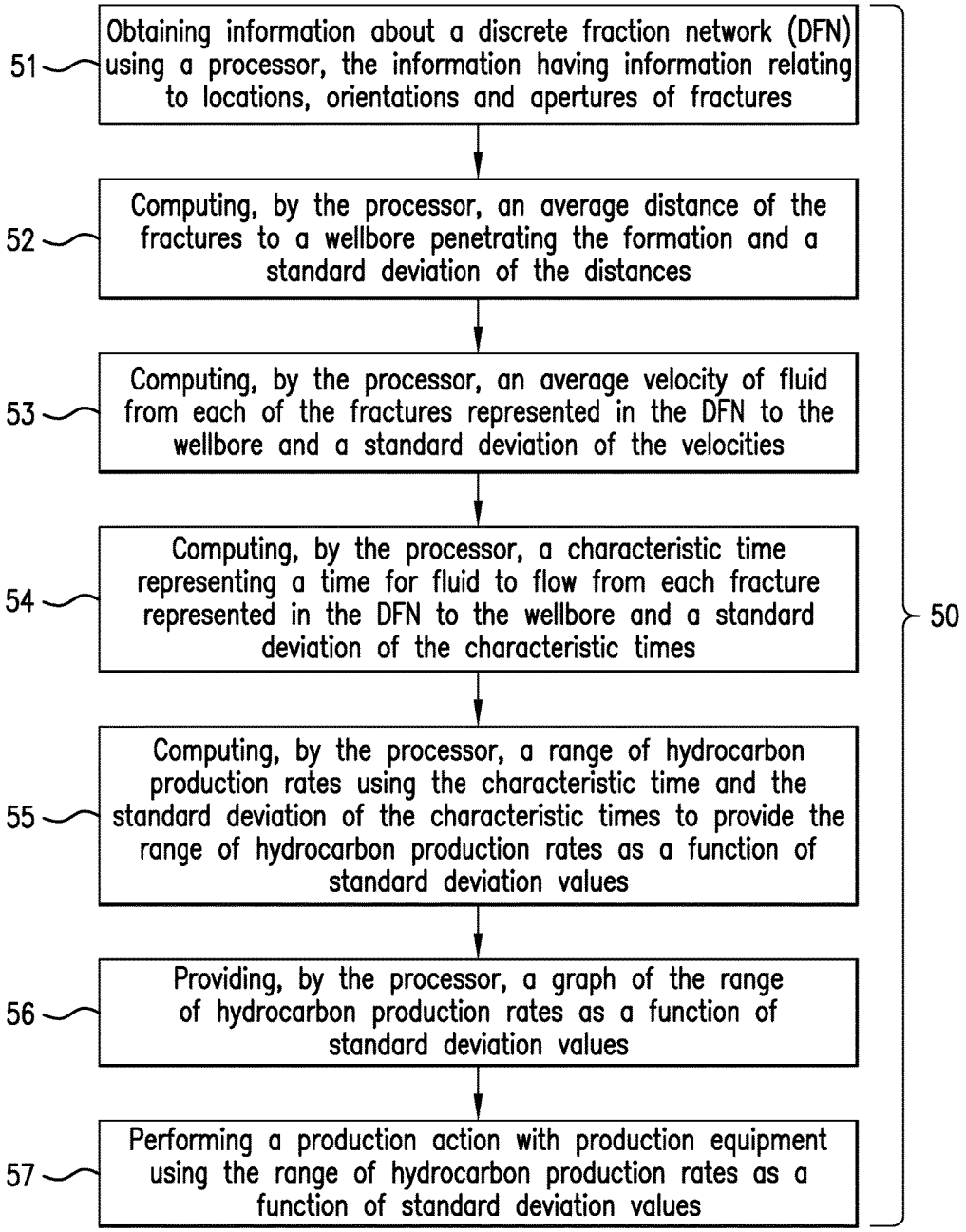
FIG. 5 is a flow chart for a method for computing a production rate of hydrocarbons from an earth formation.

FIG. 5 is a flow chart for a method 50 for computing a production rate of hydrocarbons from an earth formation. Block 51 calls for obtaining information about a discrete fraction network (DFN) using a processor, the information includes information relating to locations, orientations and apertures of fractures. In one or more embodiments, the information includes a discrete fracture description that describes locations, orientations and aperture distance for each fracture represented in the DFN. In one or more embodiments, the DFN information includes a stochastic fracture description of fractures represented in the DFN such as for example probability distributions of fracture lengths, probability distributions of orientations of fractures, and probability distributions of aperture distances of fractures. The DFN information may also include a combination of a discrete fracture description and a stochastic fracture description.

Block 52 calls for computing, by the processor, an average distance of the fractures to a wellbore penetrating the formation and a standard deviation of the distances. In one or more embodiments, the distance for each fracture is from a center of a fracture plane to a wall of the wellbore.

Figure 6:
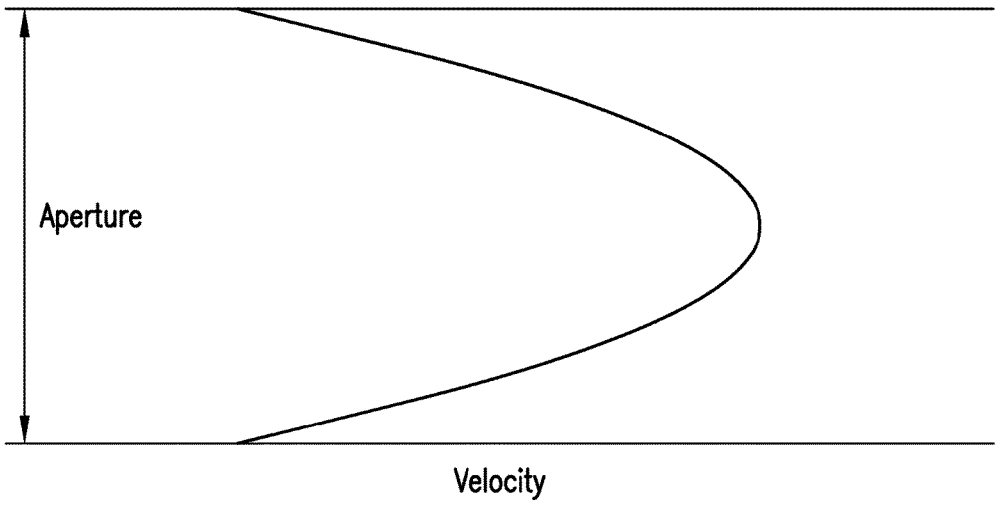
FIG. 6 illustrates an example of a velocity profile for plane Poiseuille flow.

Block 53 calls for computing, by the processor, an average velocity of fluid from each of the fractures represented in the DFN to the wellbore and a standard deviation of the velocities. In one or more embodiments, fluid flow is modeled as flow between parallel plates that are separated by a distance a, in which case the flow can be referred to as plane Poiseuille flow. Velocity for plane Poiseuille flow may be represented as $$u = \frac{1}{2\mu}\left(\frac{dp}{dx}\right)(y^2 - a\,y) \tag{6}$$

where $\mu$ is viscosity, dp/dx is the pressure gradient along the fracture (x-direction), and y is in the direction across the plate slot. FIG. 6 illustrates an example of the velocity profile for plane Poiseuille flow.

Block 54 in FIG. 5 calls for computing, by the processor, a characteristic time representing a time for fluid to flow from each fracture represented in the DFN to the wellbore and a standard deviation of the characteristic times. In one or more embodiments, the characteristic time is computed as the ratio of the average fracture distance to the wellbore to the average fluid velocity.

Block 55 calls for computing, by the processor, a range of hydrocarbon production rates using the characteristic time and the standard deviation of the characteristic times to provide the range of hydrocarbon production rates as a function of standard deviation values. In one or more embodiments, the range of hydrocarbon production rates is computed using equation (4). Block 55 may also include computing, by the processor, a range of cumulative production values using by integrating the range of hydrocarbon production rates.

Block 56 calls for providing, by the processor, a graph of the range of hydrocarbon production rates as a function of standard deviation values. In non-limiting embodiments, the graph may be a virtual graph stored in memory and available for display on a display monitor or a printed graph.

Block 57 calls for performing a production action with production equipment using the range of hydrocarbon production rates as a function of standard deviation values. Non-limiting embodiments of production actions include new or additional stimulation such as hydraulic fracturing for example, well rejuvenation such as by acid treatment or further perforations for example, and well abandonment activities such as ceasing operation of production activities (e.g., pumping). Block 57 may also include determining an acceptable level of risk and using a hydrocarbon production rate in the range of hydrocarbon production rates that is commensurate with the acceptable level of risk. For example, if an operator determines that there is a 50% chance that the price of hydrocarbons will be $A/volume unit, then the operator may choose to select the average hydrocarbon production rate or the hydrocarbon production rate associated with a 50% probability for determining the hydrocarbon production action to be performed. If the revenue from the increased hydrocarbon production at $A/volume unit due to additional stimulation is more than the cost of the stimulation, then the operator may choose to perform the additional stimulation. If the revenue from the increased hydrocarbon production is less than the cost of additional stimulation or continued operation, then the operator may elect to cease production operations and abandon the producing well. Similar decision making processes may be performed depending on the level of risk that is acceptable to the operator. In general, the number of standard deviations defining a hydrocarbon production range determines the probability of the hydrocarbon production being within that range.

The methods and systems disclosed herein provide several advantages. A first advantage is an efficient production forecast from fracture network information (i.e., no need for extensive computations or for specialists to analyze modeling input and output). A second advantage is the methods use a small number of parameters, and each of the parameters has a physical meaning (i.e., no guessing or fitting of parameters). A third advantage is that stochastic DFN data can be incorporated without an extensive computational burden. A fourth advantage is that a fast production forecast from initial production data can be performed, which allows quick estimates of cumulative production and of an economic lifetime of a well or reservoir.

It can be appreciated that the methods disclosed above are based on a physical model of a DFN, in which fractures provide the dominant fluid pathway, and in which the parameters a and c are associated with the volume of fluid-filled fractures and the recharge, or leak-in, of hydrocarbons from the matrix into the fracture. However, the methods can also be applied to a reservoir in which fractures are not relevant for fluid transport. This can be the case for hydraulically non-conductive fractures or for reservoirs without significant, or any, fracture population. In order to apply the methods in the absence of fractures, a relation of the parameter a to the volume of hydrocarbons in the vicinity of the wellbore, and the recharge term c to the permeability of the reservoir is determined. The characteristic time i in this instance is derived with the same mindset as before; it provides the characteristic time for a fluid volume to travel into the wellbore. As before, several ways to compute i are possible, including equation (5a).

Set forth below are some embodiments of the foregoing disclosure:

Embodiment 1: A method for computing a production rate of hydrocarbons from an earth formation, the method comprising: obtaining information about a discrete fraction network (DFN) using a processor, the information comprising information relating to locations, orientations and apertures of fractures; computing, by the processor, an average distance of the fractures to a wellbore penetrating the formation and a standard deviation of the distances; computing, by the processor, an average velocity of fluid from each of the fractures represented in the DFN to the wellbore and a standard deviation of the velocities; computing, by the processor, a characteristic time representing a time for fluid to flow from each fracture represented in the DFN to the wellbore and a standard deviation of the characteristic times; computing, by the processor, a range of hydrocarbon production rates using the characteristic time and the standard deviation of the characteristic times to provide the range of hydrocarbon production rates as a function of standard deviation values; and providing, by the processor, a graph of the range of hydrocarbon production rates as a function of standard deviation values.

Embodiment 2: The method according to claim 1, wherein the graph is a virtual graph comprising data points that may be displayed as graph or a printed graph.

Embodiment 3: The method according to claim 1, further comprising performing a production action with production equipment using the range of hydrocarbon production rates as a function of standard deviation values.

Embodiment 4: The method according to claim 3, wherein the production action comprises stimulating the earth formation, rejuvenating a wellbore used for production of the hydrocarbons, ceasing hydrocarbon production activities, or performing abandonment activities for the wellbore.

Embodiment 5: The method according to claim 1, wherein computing a characteristic time comprises using the ratio of average fracture distance to the wellbore over the average fluid velocity as the characteristic time.

Embodiment 6: The method according to claim 5, wherein computing a standard deviation of the characteristic times comprises solving the following equation $$\sigma_\tau = \left|\frac{\bar{d}\boxed{?}}{\bar{u}}\right| \sqrt{\left(\frac{\sigma_d}{\bar{d}}\right)^2 + \boxed{?}\left(\frac{\sigma_u}{\bar{u}}\right)^2 - 2\boxed{?}\left(\frac{\sigma_{du}}{\bar{d}\,\bar{u}}\right)^2}$$

where $$\frac{\bar{d}\boxed{?}}{\bar{u}}$$

is the ratio of average fracture distance to the well over the average fluid velocity as the characteristic time, $\sigma_d$ is the standard distribution of d the distance from each fracture to the wellbore, $\sigma_u$, is the standard deviation of the fluid velocity for each fracture, and $\sigma_{du}$ is the covariance.

Embodiment 7: The method according to claim 1, wherein computing a range of hydrocarbon production rates using the characteristic time and the standard deviation of the characteristic times comprises solving an equation that relates a hydrocarbon production rate to (i) the characteristic time, (ii) an initial production rate (a) related to total volume of fluid-filled fractures, (iii) a limiting production rate (c) related to leak-in rate of formation fluid into fractures in DFN, and time (t).

Embodiment 8: The method according to claim 7, wherein computing a range of hydrocarbon production rates comprises solving the following equation: $Q(t)=(a-c)\,\mathrm{erfc}(t/\tau)+c$ where Q(t) is the hydrocarbon production rate as a function of time and erfc is the complementary error function.

Embodiment 9: An apparatus for computing a production rate of hydrocarbons from an earth formation, the apparatus comprising: a processor configured to: obtain information about a discrete fraction network (DFN), the information comprising information relating to locations, orientations and apertures of fractures; compute an average distance of the fractures to a wellbore penetrating the formation and a standard deviation of the distances; compute an average velocity of fluid from each of the fractures represented in the DFN to the wellbore and a standard deviation of the velocities; compute a characteristic time representing a time for fluid to flow from each fracture represented in the DFN to the wellbore and a standard deviation of the characteristic times; compute a range of hydrocarbon production rates using the characteristic time and the standard deviation of the characteristic times to provide the range of hydrocarbon production rates as a function of standard deviation values; and provide a graph of the range of hydrocarbon production rates as a function of standard deviation values.

Embodiment 10: The apparatus according to claim 9, further comprising production equipment configured to perform a production action using the range of hydrocarbon production rates as a function of standard deviation values.

Embodiment 11: The apparatus according to claim 10, wherein the production equipment comprises a hydraulic stimulation apparatus.

Embodiment 12: The apparatus according to claim 10, wherein the production equipment comprises an acid treatment system.

In support of the teachings herein, various analysis components may be used, including a digital and/or an analog system. For example, the production rig 10, the downhole tool 8, and/or the computer processing system 12 may include digital and/or analog systems. The system may have components such as a processor, storage media, memory, input, output (e.g. display or printer), communications link, user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure. Processed data such as a result of an implemented method may be transmitted as a signal via a processor output interface to a signal receiving device. The signal receiving device may be a computer display or a printer for presenting the result to a user. Alternatively or in addition, the signal receiving device may be a storage medium or memory for storing the result. Further, an alert maybe transmitted from the processor to a user interface if the result exceeds or is less than a threshold value. Further, the result may be transmitted to a controller or processor for executing an algorithm related to production that uses the result as input.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for transforming at least one of an earth formation and production equipment based on computing a production rate of hydrocarbons from the earth formation, the method comprising:

obtaining information about a discrete fraction network (DFN) using a processor, the information comprising information relating to locations, orientations and apertures of fractures;

computing, by the processor, an average distance of the fractures to a wellbore penetrating the formation and a standard deviation of the distances;

computing, by the processor, an average velocity of fluid from each of the fractures represented in the DFN to the wellbore and a standard deviation of the velocities;

computing, by the processor, a characteristic time ($\tau$) representing a time for fluid to flow from each fracture represented in the DFN to the wellbore and a standard deviation of the characteristic times;

computing, by the processor, a range of hydrocarbon production rates using the characteristic time and the standard deviation of the characteristic times to provide the range of hydrocarbon production rates as a function of standard deviation values;

providing, by the processor, a graph of the range of hydrocarbon production rates as a function of standard deviation values; and transforming at least one of the earth formation and the production equipment based on the range of hydrocarbon production rates as a function of standard deviation values;

wherein the computing of the range of hydrocarbon production rates using the characteristic time and the standard deviation of the characteristic times comprises solving an equation that relates a hydrocarbon production rate to (i) the characteristic time, (ii) an initial production rate (a) related to total volume of fluid-filled fractures, (iii) a limiting production rate (c) related to leak-in rate of formation fluid into fractures in DFN, and time (t).

2. The method according to claim 1, wherein the graph is a virtual graph comprising data points that may be displayed as graph or a printed graph.

3. The method according to claim 1, wherein the transforming of the earth formation comprises performing a production action with production equipment using the range of hydrocarbon production rates as a function of standard deviation values.

4. The method according to claim 3, wherein the production action comprises stimulating the earth formation, rejuvenating a wellbore used for production of the hydrocarbons, ceasing hydrocarbon production activities, or performing abandonment activities for the wellbore.

5. The method according to claim 1, wherein computing a characteristic time comprises using the ratio of average fracture distance to the wellbore over the average fluid velocity as the characteristic time.

6. A method for transforming at least one of an earth formation and production equipment based on computing a production rate of hydrocarbons from an earth formation, the method comprising:

obtaining information about a discrete fraction network (DFN) using a processor, the information comprising information relating to locations, orientations and apertures of fractures;

computing, by the processor, an average distance of the fractures to a wellbore penetrating the formation and a standard deviation of the distances;

computing, by the processor, an average velocity of fluid from each of the fractures represented in the DFN to the wellbore and a standard deviation of the velocities;

computing, by the processor, a characteristic time representing a time for fluid to flow from each fracture represented in the DFN to the wellbore and a standard deviation of the characteristic times;

computing, by the processor, a range of hydrocarbon production rates using the characteristic time and the standard deviation of the characteristic times to provide the range of hydrocarbon production rates as a function of standard deviation values; and providing, by the processor, a graph of the range of hydrocarbon production rates as a function of standard deviation values;

transforming at least one of the earth formation and the production equipment based on the range of hydrocarbon production rates as a function of standard deviation values;

wherein computing a standard deviation of the characteristic times $\sigma_\tau$ comprises solving the following equation $$\sigma_\tau = \left|\frac{\bar{d}}{\bar{u}}\right|\sqrt{\left(\frac{\sigma_d}{\bar{d}}\right)^2 + \left(\frac{\sigma_u}{\bar{u}}\right)^2 - 2\left(\frac{\sigma_{du}}{\bar{d}\bar{u}}\right)^2}$$

where $$\frac{\bar{d}}{\bar{u}}$$

is the ratio of average fracture distance to the well over the average fluid velocity as the characteristic time $\tau$, $\sigma_d$ is the standard deviation of d the distance from each fracture to the wellbore, $\sigma_u$ is the standard deviation of the fluid velocity for each fracture, and $\sigma_{du}$ is the covariance.

7. The method according to claim 1, wherein computing a range of hydrocarbon production rates comprises solving the following equation:

$$Q(t)=(a-c)erfc(t/\tau)+c$$

where Q(t) is the hydrocarbon production rate as a function of time, a is an initial production rate related to total volume of fluid-filled fractures, c is a limiting production rate related to leak-in rate of formation fluid into fractures in DFN, t is time, $\tau$ is the characteristic time, and erfc is the complementary error function.

8. An apparatus for transforming at least one of an earth formation and production equipment based on computing a production rate of hydrocarbons from an earth formation, the apparatus comprising:

a processor configured to:

obtain information about a discrete fraction network (DFN), the information comprising information relating to locations, orientations and apertures of fractures;

compute an average distance of the fractures to a wellbore penetrating the formation and a standard deviation of the distances;

compute an average velocity of fluid from each of the fractures represented in the DFN to the wellbore and a standard deviation of the velocities;

compute a characteristic time representing a time for fluid to flow from each fracture represented in the DFN to the wellbore and a standard deviation of the characteristic times;

compute a range of hydrocarbon production rates using the characteristic time and the standard deviation of the characteristic times to provide the range of hydrocarbon production rates as a function of standard deviation values; and provide a graph of the range of hydrocarbon production rates as a function of standard deviation values, wherein the computing of the range of hydrocarbon production rates using the characteristic time and the standard deviation of the characteristic times comprises solving an equation that relates a hydrocarbon production rate to (i) the characteristic time ($\tau$), (ii) an initial production rate (a) related to total volume of fluid-filled fractures, (iii) a limiting production rate (c) related to leak-in rate of formation fluid into fractures in DFN, and time (t);

production equipment configured to at least one of transform the earth formation and be transformed from one state to another state based on the range of hydrocarbon production rates as a function of standard deviation values.

9. The apparatus according to claim 8, wherein the production equipment is configured to at least one of transform from a non-operating state to an operating state and transform from an operating state to a non-operating state.

10. The apparatus according to claim 9, wherein the production equipment comprises a hydraulic stimulation apparatus.

11. The apparatus according to claim 9, wherein the production equipment comprises an acid treatment system.

12. The method according to claim 4, wherein the production action comprises the ceasing of the hydrocarbon production activities, and wherein the ceasing of the hydrocarbon production activities comprises ceasing pumping operations.

* * * * *